US010161628B2

(12) United States Patent
Seeley

(10) Patent No.: US 10,161,628 B2
(45) Date of Patent: Dec. 25, 2018

(54) RADIANT BURNER

(71) Applicant: Edwards Limited, Crawley, West Sussex (GB)

(72) Inventor: Andrew James Seeley, Clevedon (GB)

(73) Assignee: Edwards Limited, Burgess Hill (GB)

( * ) Notice: Subject to any disclaimer, the term of this patent is extended or adjusted under 35 U.S.C. 154(b) by 331 days.

(21) Appl. No.: 14/786,596

(22) PCT Filed: Mar. 14, 2014

(86) PCT No.: PCT/GB2014/050779
§ 371 (c)(1),
(2) Date: Oct. 23, 2015

(87) PCT Pub. No.: WO2014/174239
PCT Pub. Date: Oct. 30, 2014

(65) Prior Publication Data

US 2016/0153655 A1 Jun. 2, 2016

(30) Foreign Application Priority Data

Mar. 14, 2014 (GB) ..... 1307489.3

(51) Int. Cl.
*F23G 7/06* (2006.01)
*F23D 14/12* (2006.01)
(Continued)

(52) U.S. Cl.
CPC ..... *F23D 14/12* (2013.01); *F23C 99/006* (2013.01); *F23D 14/16* (2013.01); *F23D 14/70* (2013.01);
(Continued)

(58) Field of Classification Search
CPC ..... F23C 99/006; F23D 14/16; F23D 14/70; F23D 14/12; F23D 2212/10; F23G 7/065; F23G 7/06; F23G 2209/142
See application file for complete search history.

(56) References Cited

U.S. PATENT DOCUMENTS 5,147,201 A 9/1992 Xiong
5,147,511 A 9/1992 Woebcke
(Continued)

FOREIGN PATENT DOCUMENTS

CN 1061771 A 6/1992
EP 0694735 A1 1/1996
(Continued)

OTHER PUBLICATIONS

Combined Search and Examination Report under Sections 17 and 18(3) dated Dec. 9, 2013 in counterpart GB Application No. GB1307489.3, 5 pgs.
(Continued)

*Primary Examiner* — Alfred Basichas
(74) *Attorney, Agent, or Firm* — Shumaker & Sieffert, P.A.

(57) ABSTRACT

A radiant burner for treating an effluent gas stream from a manufacturing process tool may include: a combustion chamber having a porous sleeve through which combustion materials pass for combustion proximate to a combustion surface of the porous sleeve; and a plenum surrounding the porous sleeve supplying the combustion materials to the porous sleeve, the plenum being configured to provide the combustion materials with varying stoichiometry along a length of the porous sleeve. This approach of varying the stoichiometric ratios of the combustion materials correspondingly varies the heat generated by those combustion materials along the length of the porous sleeve. By varying the stoichiometry of the combustion materials to compensate
(Continued)

for variations in the heat generated within the combustion chamber along the length of the porous sleeve, a more uniform temperature can be achieved along the length of the porous sleeve within the combustion chamber.

18 Claims, 1 Drawing Sheet

(51) Int. Cl.
*F23C 99/00* (2006.01)
*F23D 14/16* (2006.01)
*F23D 14/70* (2006.01)

(52) U.S. Cl.
CPC ..... *F23G 7/06* (2013.01); *F23G 7/065* (2013.01); *F23D 2212/10* (2013.01); *F23G 2209/142* (2013.01)

(56) References Cited

U.S. PATENT DOCUMENTS

| | | | |
|---|---|---|---|
| 5,938,422 | A | 8/1999 | Smith et al. |
| 6,054,549 | A | 4/2000 | Bahadur et al. |
| 6,234,787 | B1 | 5/2001 | Endoh et al. |
| 2007/0172398 | A1 | 7/2007 | Clark et al. |

FOREIGN PATENT DOCUMENTS

| | | | |
|---|---|---|---|
| GB | 1463663 | | 2/1977 |
| JP | 08105618 | H | 4/1996 |
| JP | 09145019 | H | 6/1997 |
| JP | 2001280629 | A | 10/2001 |
| JP | 2005291675 | A | 10/2005 |
| JP | 2006194544 | A | 7/2006 |
| JP | 4290836 | B2 | 7/2009 |
| WO | 2008122819 | A1 | 10/2008 |

OTHER PUBLICATIONS

International Search Report and Written Opinion dated May 15, 2014 in counterpart International Application No. PCT/GB2014/050779, 11 pgs.

First Office Action of corresponding Chinese Patent Application No. 201480023109.5 dated Jul. 8, 2016, dated Jul. 18, 2016. 8 pages.

Translation of First Office Action and Search Report of corresponding Chinese Patent Application No. 201480023109.5 dated Aug. 12, 2016. 17 pages.

First Office Action of counterpart Japanese Patent Application No. 2016-509537 dated Nov. 29, 2017. 4 pages.

Translation of First Office Action of counterpart Japanese Patent Application No. 2016-509537 dated Nov. 29, 2017. 2 pages.

RADIANT BURNER

This application is a national stage entry under 35 U.S.C. § 371 of International Application No. PCT/GB2014/050779, filed Mar. 14, 2014, which claims the benefit of G.B. Application 1307489.3, filed Apr. 25, 2013. The entire contents of International Application No. PCT/GB2014/050779 and G.B. Application 1307489.3 are incorporated herein by reference.

TECHNICAL FIELD

The present disclosure relates to a radiant burner and method.

BACKGROUND

Radiant burners are known and are typically used for treating an effluent gas stream from a manufacturing process tool used in, for example, the semiconductor or flat panel display manufacturing industry. During such manufacturing, residual perfluorinated compounds (PFCs) and other compounds exist in the effluent gas stream pumped from the process tool. PFCs are difficult to remove from the effluent gas and their release into the environment is undesirable because they are known to have relatively high greenhouse activity.

Known radiant burners use combustion to remove the PFCs and other compounds from the effluent gas stream. Typically, the effluent gas stream is a nitrogen stream containing PFCs and other compounds. A fuel gas is mixed with the effluent gas stream and that gas stream mixture is conveyed into a combustion chamber that is laterally surrounded by the exit surface of a foraminous gas burner. Fuel gas and air are simultaneously supplied to the foraminous burner to affect flameless combustion at the exit surface, with the amount of air passing through the foraminous burner being sufficient to consume not only the fuel gas supplied to the burner, but also all the combustibles in the gas stream mixture injected into the combustion chamber.

Although techniques exist for processing the effluent gas stream, they each have their own shortcomings. Accordingly, it is desired to provide an improved technique for processing an effluent gas stream.

SUMMARY

According to a first aspect, there is provided a radiant burner for treating an effluent gas stream from a manufacturing process tool, the radiant burner comprising: a combustion chamber having a porous sleeve through which combustion materials pass for combustion proximate to a combustion surface of the porous sleeve; and a plenum surrounding the porous sleeve supplying the combustion materials to the porous sleeve, the plenum being configured to provide the combustion materials with varying stoichiometry along a length of the porous sleeve.

The first aspect recognises that a problem with existing radiant burners is that conditions within the combustion chamber can lead to variations in temperature within the combustion chamber, which ought to be as uniform as possible. In particular, the first aspect recognises that temperature variations along the length of the combustion chamber can reduce the efficiency and life of the radiant burner.

Accordingly, a radiant burner which may treat an effluent gas stream may be provided. The radiant burner may comprise a combustion chamber which may have a porous sleeve through which combustion materials may pass in order to combust approximate or adjacent to a combustion surface of the porous sleeve. A plenum may be provided which surrounds the porous sleeve and which supplies the combustion materials to the porous sleeve. The plenum may be configured, adapted or arranged to provide combustion materials with a varying or differing stoichiometry along the length of the porous sleeve. This approach of varying the stoichiometric ratios of the combustion materials correspondingly varies the heat generated by those combustion materials along the length of the porous sleeve. By varying the stoichiometry of the combustion materials to compensate for variations in the heat generated within the combustion chamber along the length of the porous sleeve, a more uniform temperature can be achieved along the length of the porous sleeve within the combustion chamber.

In one embodiment, the combustion chamber extends axially from an effluent gas stream inlet from which the effluent gas is provided to the combustion chamber to an exhaust from which treated effluent gas is exhausted and the plenum is configured to provide the combustion materials with varying stoichiometry along an axial length of the porous sleeve. Hence the combustions may be provided in different stoichiometric ratios along the axial length of the porous sleeve.

In one embodiment, the plenum is configured to increase the stoichiometry of an oxidant of the combustion materials towards the effluent gas stream inlet. Accordingly, a more lean combustion material may be provided in the vicinity of the effluent gas stream inlet in order to reduce the heat generated by the combustion materials in a region where high amounts of heat are generated due to combustion of the effluent gas stream. This may be achieved by increasing the ratio of oxidant (or decreasing the ratio of fuel) in the combustion materials towards the inlet. Embodiments recognise that more heat is generated in the vicinity of the effluent gas stream inlet which, with a uniform stoichiometry of combustion materials along the length of the combustion chamber, would lead to this region becoming much hotter than elsewhere and which can lead to sintering or degradation of the porous sleeve.

In one embodiment, the plenum is configured to decrease the stoichiometry of an oxidant of the combustion materials towards the exhaust. Accordingly, a more rich combustion material may be provided in the vicinity of the exhaust in order to increase the heat generated by the combustion materials in a region where high amounts of heat loss occurs. This may be achieved by decreasing the ratio of oxidant (or increasing the ratio of fuel) in the combustion materials towards the exhaust. Embodiments recognise that a high degree of heat loss can occur in the vicinity of the exhaust, due to the cooling effects of any downstream processing apparatus, such as a weir. This again helps to create a more uniform temperature along the length of the porous sleeve.

In one embodiment, the plenum is configure to increase the stoichiometry of an oxidant of the combustion materials towards the effluent gas stream inlet compared to the stoichiometry of an oxidant of the combustion materials towards the exhaust. Accordingly, the stoichiometric ratios of the combustion material are configured increase the amount of excess oxidant (and/or decrease the amount of excess fuel) towards the gas stream inlet compared to that in the vicinity of the exhaust.

In one embodiment, the plenum is configure to decrease the stoichiometry of an oxidant of the combustion materials towards the exhaust compared to the stoichiometry of an oxidant of the combustion materials towards the effluent gas stream inlet. Accordingly, the stoichiometric ratios of the combustion material are configured decrease the amount of excess oxidant (and/or increase the amount of excess fuel) towards the exhaust inlet compared to that in the vicinity of the inlet.

In one embodiment, the combustion materials comprise a fuel and oxidant mixture and the plenum is configured to lower a fuel to oxidant ratio towards the effluent gas stream inlet.

In one embodiment, the combustion materials comprise a fuel and oxidant mixture and the plenum is configured to raise a fuel to oxidant ratio towards the exhaust.

In one embodiment, the combustion materials comprise a fuel and oxidant mixture and the plenum is configured to lower a fuel to oxidant ratio towards the effluent gas stream inlet compared to a fuel to oxidant ratio towards the exhaust.

In one embodiment, the combustion materials comprise a fuel and oxidant mixture and the plenum is configured to raise a fuel to oxidant ratio towards the exhaust compared to a fuel to oxidant ratio towards the effluent gas stream inlet.

In one embodiment, the plenum comprises a combustion materials inlet which provides the combustion materials to the plenum and an oxidant inlet which provides oxidant in a vicinity of the effluent gas stream inlet to increase the stoichiometry of the oxidant of the combustion materials towards the effluent gas stream inlet.

Adding additional oxidant in the vicinity of the inlet creates a leaner mixture by decreasing the ratio of fuel and decreases the stoichiometric excess fuel near the inlet.

In one embodiment, the plenum comprises an oxidant inlet baffle in a vicinity of the oxidant inlet to create a region of increased stoichiometry of the oxidant of the combustion materials towards the effluent gas stream inlet. Providing a baffle helps to prevent mixing of different regions of differing stoichiometry combustion materials in order to provide varying stoichiometric ratios of oxidant along the length of the porous sleeve.

In one embodiment, the plenum comprises a combustion materials inlet which provides the combustion materials to the plenum and a fuel inlet which provides fuel in a vicinity of the exhaust to decrease the stoichiometry of an oxidant of the combustion materials towards the exhaust. Adding additional fuel in the vicinity of the exhaust creates a richer mixture by increasing the ratio of fuel and decreases the stoichiometric excess oxidant near the exhaust.

In one embodiment, the plenum comprises a fuel inlet baffle in a vicinity of the fuel inlet to create a region of decreased stoichiometry of an oxidant of the combustion materials towards the exhaust.

In one embodiment, at least one of the fuel inlet baffle and the exhaust inlet baffle reduce fluid communication between a region in a vicinity of the combustion materials inlet and regions in a vicinity of the fuel inlet and the oxidant inlet to vary the stoichiometry of an oxidant in these regions.

In one embodiment, the plenum comprises a plurality of adjacent plenums, each providing combustion materials with differing stoichiometry. Accordingly, a number of separate, adjacent plenums may be provided along the length of the porous sleeve in order to supply combustion materials with differing stoichiometry.

According to a second aspect, there is provided a method of treating an effluent gas stream from a manufacturing process tool, the method comprising: combusting combustion materials proximate to a combustion surface of a porous sleeve of a combustion; supplying the combustion materials to the porous sleeve from a plenum surrounding the porous sleeve with varying stoichiometry along a length of the porous sleeve.

In one embodiment, the combustion chamber extends axially from an effluent gas stream inlet from which the effluent gas is provided to the combustion chamber to an exhaust from which treated effluent gas is exhausted and the step of supplying comprises supplying the combustion materials with varying stoichiometry along an axial length of the porous sleeve.

In one embodiment, the step of supplying comprises increasing the stoichiometry of an oxidant of the combustion materials towards the effluent gas stream inlet.

In one embodiment, the step of supplying comprises decreasing the stoichiometry of an oxidant of the combustion materials towards the exhaust.

In one embodiment, the step of supplying comprises increasing the stoichiometry of an oxidant of the combustion materials towards the effluent gas stream inlet compared to the stoichiometry of an oxidant of the combustion materials towards the exhaust.

In one embodiment, the step of supplying comprises decreasing the stoichiometry of an oxidant of the combustion materials towards the exhaust compared to the stoichiometry of an oxidant of the combustion materials towards the effluent gas stream inlet.

In one embodiment, the combustion materials comprise a fuel and oxidant mixture and the step of supplying comprises lowering a fuel to oxidant ratio towards the effluent gas stream inlet.

In one embodiment, the combustion materials comprise a fuel and oxidant mixture and the step of supplying comprises raising a fuel to oxidant ratio towards the exhaust.

In one embodiment, the combustion materials comprise a fuel and oxidant mixture and the step of supplying comprises lowering a fuel to oxidant ratio towards the effluent gas stream inlet compared to a fuel to oxidant ratio towards the exhaust.

In one embodiment, the combustion materials comprise a fuel and oxidant mixture and the step of supplying comprises raising a fuel to oxidant ratio towards the exhaust compared to a fuel to oxidant ratio towards the effluent gas stream inlet.

In one embodiment, the step of supplying comprises providing the combustion materials to the plenum using a combustion materials inlet and providing oxidant to the plenum in a vicinity of the effluent gas stream inlet using an oxidant inlet which to increase the stoichiometry of the oxidant of the combustion materials towards the effluent gas stream inlet.

In one embodiment, the step of supplying comprises creating a region of increased stoichiometry of the oxidant of the combustion materials towards the effluent gas stream inlet using an oxidant inlet baffle in a vicinity of the oxidant inlet.

In one embodiment, the step of supplying comprises providing the combustion materials to the plenum using a combustion materials inlet and providing fuel to the plenum using a fuel inlet in a vicinity of the exhaust to decrease the stoichiometry of an oxidant of the combustion materials towards the exhaust.

In one embodiment, the step of supplying comprises creating a region of decreased stoichiometry of an oxidant of the combustion materials towards the exhaust using a fuel inlet baffle in a vicinity of the fuel inlet.

In one embodiment, the step of supplying comprises reducing fluid communication between a region in a vicinity of a combustion materials inlet and regions in a vicinity of the fuel inlet and the oxidant inlet to vary the stoichiometry of an oxidant in these regions.

In one embodiment, the step of supplying comprises providing combustion materials with differing stoichiometry to a plurality of adjacent plenums.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings.

DETAILED DESCRIPTION

Figures 1A, 1B:
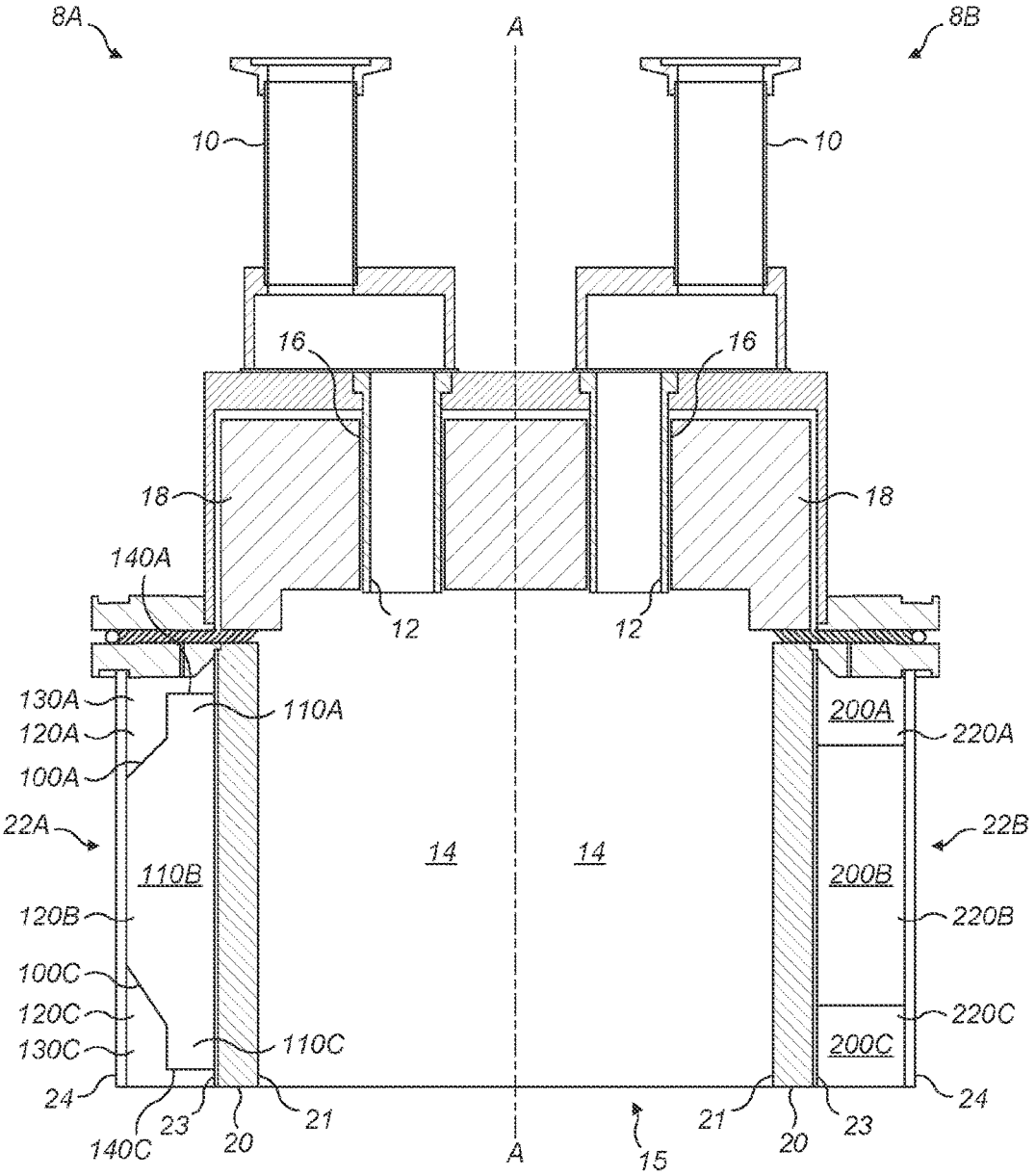
FIGS. 1A and 1B illustrate a radiant burner according to embodiments.

Before discussing the embodiments in any more detail, first an overview will be provided. Embodiments provide a radiant burner arrangement which is used in the processing of an effluent gas stream. In particular, the radiant burner is arranged to provide a variable stoichiometry of the combustion materials along the length of the porous sleeve of the burner. That is to say, the radiant burner is arranged to provide variable stoichiometric ratios of the materials which comprise the combustion materials within the burner in order to reduce temperature variation within the burner. For example, if a central or middle region of the burner is operating at a nominal surface firing rate and using combustion materials with a desired nominal stoichiometry (i.e. with a nominal ratio of fuel to oxidant), then it is beneficial to be able to operate the upper parts of the burner (those parts closest to the inlet which receives the effluent gas stream) lean (that is to reduce the ratio of fuel to oxidant compared to the nominal ratio) to reduce surface temperatures and minimise thermal degradation of the porous sleeve. Likewise, it is beneficial to operate the lower regions of the burner (those parts closest to the exhaust) rich (that is to increase the ratio of fuel to oxidant compared to the nominal ratio) in order to increase temperature and counter the thermal losses due to radiation onto any cooled surfaces of any cooling weir located in proximity to the exhaust.

One embodiment feeds a main burner plenum area with a normal fuel-air premix and provides a second plenum area fed with a more fuel-rich premix at the lower regions of the burner. Another embodiment feeds the top of the plenum with a lean mixture and the bottom of the plenum with a rich mixture and allows for an intermediate, normal fuel-air premix in a middle region. Another embodiment operates the whole fuel burner with a normal fuel-air premix and adds extra air to the upper parts and/or extra fuel to the lower parts.

In one embodiment, the stoichiometric excess of oxidant is increased towards the inlet which receives the effluent gas. This causes these regions to operate lean and reduce surface temperatures to minimise thermal degradation. Likewise, the stoichiometric excess of oxidant to fuel is decreased towards the exhaust in order to operate this part of the burner rich to increase surface temperatures in this region. This helps to provide more uniform temperatures along the length of the burner.

All of these arrangements provide for a variable stoichiometry of the combustion materials along the length of the porous sleeve in order to vary the heat generated along the length of the porous sleeve in order to reduce the variation of temperature within the combustion chamber. For example, when considering the stoichiometry in terms of a post-combustion oxygen concentration (i.e. the residual oxygen following combustion of the combustion materials on exit surface of the foraminous burner), a nominal residual oxygen concentration of around 9% to 9.5% may be provided, whilst a residual oxygen concentration of around 7.5% to 8.5% may be provided within the fuel-rich region towards the exhaust and a residual oxygen concentration of around 9.5% to 10.5% (such as 10%) may be provided within the fuel-lean region towards the inlet. It will be appreciated that these values will vary from fuel to fuel; for example, a burner using propane or liquefied petroleum gas (LPG) will be operated at slightly higher residual oxygen levels than the same burner using methane or natural gas.

Radiant Burner—General Configuration and Operation

FIGS. 1A and 1B illustrate two radiant burners, generally 8A and 8B, according to embodiments. FIGS. 1A and 1B each illustrate a respective halve of a radiant burner, which are symmetrical about the axis A-A. Both the radiant burners 8A; 8B treat an effluent gas stream pumped from a manufacturing process tool such as a semiconductor or flat panel display process tool, typically by means of a vacuum-pumping system. The effluent stream is received at inlets 10. The effluent stream is conveyed from the inlet 10 to a nozzle 12 which injects the effluent stream into a cylindrical combustion chamber 14. In these embodiments, the radiant burners 8A; 8B each comprise four inlets 10 arranged circumferentially, each conveying an effluent gas stream pumped from a respective tool by a respective vacuum-pumping system. Alternatively, the effluent stream from a single process tool may be split into a plurality of streams, each one of which is conveyed to a respective inlet. Each nozzle 12 is located within a respective bore 16 formed in a ceramic top plate 18 which defines an upper or inlet surface of the combustion chamber 14. The combustion chamber 14 has side walls defined by an exit surface 21 of a foraminous burner element 20, such as that described in EP0694735. The burner element 20 is cylindrical and is retained within a cylindrical outer shell 24.

As will be described in more detail below, a plenum volume 22A, 22B is defined between an entry surface of the burner element 20 and the cylindrical outer shell 24. A mixture of fuel gas, such as natural gas or a hydrocarbon, and air is introduced into the plenum volume 22A, 22B via inlet nozzles. The mixture of fuel gas and air passes from the entry surface 23 of the burner element to the exit surface 21 of the burner element for combustion within the combustion chamber 14.

The nominal ratio of the mixture of fuel gas and air is varied to vary the nominal temperature within the combustion chamber 14 to that which is appropriate for the effluent gas stream to be treated. Also, the rate at which the mixture of fuel gas and air is introduced into the plenum volume 22A, 22B is adjusted so that the mixture will burn without visible flame at the exit surface 21 of the burner element 20. The exhaust 15 of the combustion chamber 40 is open to enable the combustion products to be output from the radiant burner 8A, 8B.

Accordingly, it can be seen that the effluent gas received through the inlets 10 and provided by the nozzles 12 to the combustion chamber 14 is combusted within the combustion chamber 14 which is heated by a mixture of fuel gas and air which combusts near the exit surface 21 of the burner element. Such combustion causes heating of the chamber 14 and provides combustion products, such as oxygen, typically with a nominal range of 7.5% to 10.5%, depending on the fuel air mixture ($CH_4$, $C_3H_8$, $C_4H_{10}$), provided to the combustion chamber 14. The heat and combustion products react with the effluent gas stream within the combustion chamber 14 to clean the effluent gas stream. For example, $SiH_4$ and $NH_3$ may be provided within the effluent gas stream, which reacts with $O_2$ within the combustion chamber to generate $SiO_2$, $N_2$, $H_2O$, NOX. Similarly, $N_2$, $CH_4$, $C_2F_6$ may be provided within the effluent gas stream, which reacts with $O_2$ within the combustion chamber to generate $CO_2$, HF, $H_2O$.

Baffled Plenum Arrangement

Turning now to the arrangement of the plenum 22A of the radiant burner 8A of FIG. 1A, an upper baffle 100A and a lower baffle 100C are provided. An inlet 120B is provided which provides a fuel air mixture to a region 110B within the plenum 22A. An air inlet 120A is provided which feeds air to a region 130A enclosed by the upper baffle 100A. An inlet 120C is provided which feeds fuel into a region 130C enclosed by the lower baffle 100C.

The upper baffle 100A is provided with vents 140A through which air from the region 130A can mix in a region 110A within the plenum 22A with the fuel air mixture from the region 110B in order to create the region 130A where the mixture is lean.

Likewise, the lower baffle 100C is provided with vents 140C through which the fuel within the region 130C can mix with the fuel air mixture from the region 110B in order to enrich the fuel air mixture within the region 110C.

Accordingly, the provision of the lower and upper baffles 100A; 100C enables the stoichiometry of the fuel air mixture to be varied along the length of the plenum 22A. This enables the heat generated along the length of the foraminous burner 20 to be adjusted in order to compensate for increases in temperature which would otherwise occur towards the nozzles 12, which can cause thermal damage, and the decrease in temperature that would otherwise occur towards the exhaust 15 which would lead to incomplete processing of the effluent gas stream.

Although two different baffles 100A, 100C and three inlets 120A-C are shown, it will be appreciated that alternative arrangements may be utilised to vary the stoichiometry of the combustion materials, as mentioned above.

Multiple Plenum Arrangements

FIG. 1B illustrates a radiant burner 8B according to one embodiment, having a plenum 22B formed of three adjacent sections 200A, 200B, 200C. In this arrangement, an inlet 220A feeds the plenum section 200A with a fuel air mixture which is lean and has been enhanced with a stoichiometric excess of oxidant. Hence, region 200A has a lower ratio of fuel to air than that provided to regions 200B or 200C. An inlet 220B provides a fuel air mixture to the plenum section 200B having a nominal fuel-to-air ratio, which has a higher proportion of fuel than that provided to the region 200A. An inlet 220C provides a fuel air mixture having stoichiometric excess of fuel to the region 200C. Hence, region 200C has a higher ratio of fuel to air than that provided to regions 200A or 200B.

As with the arrangement described above, this enables a fuel air mixture to be provided to the foraminous burner 20 with variable stoichiometry along its length in order to vary the heat generation along the length of the foraminous burner in order to compensate for excessive heat being produced towards the inlet and insufficient heat being produced towards the exhaust 15.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

The invention claimed is:

1. A radiant burner for treating an effluent gas stream from a manufacturing process tool, the radiant burner comprising:

a combustion chamber comprising a porous sleeve through which combustion materials pass for combustion proximate to a combustion surface of the porous sleeve; and a plenum surrounding the porous sleeve, wherein the plenum is configured to supply the combustion materials to an outer surface of the porous sleeve opposite the combustion surface with varying stoichiometry along a length of the porous sleeve.

2. The radiant burner of claim 1, wherein the combustion chamber extends axially from an effluent gas stream inlet from which the effluent gas is provided to the combustion chamber to an exhaust from which treated effluent gas is exhausted, and wherein the plenum is configured to provide the combustion materials with varying stoichiometry along an axial length of the porous sleeve.

3. The radiant burner of claim 2, wherein the plenum is configured to at least one of:

provide the combustion materials to the outer surface of the porous sleeve with increased stoichiometry of an oxidant of the combustion materials towards the effluent gas stream inlet; or provide the combustion materials to the outer surface of the porous sleeve with a decrease of an the oxidant of the combustion materials towards the exhaust.

4. The radiant burner of claim 2, wherein the plenum is configured to at least one of:

provide the combustion materials to the outer surface of the porous sleeve with increased stoichiometry of an oxidant of the combustion materials towards the effluent gas stream inlet compared to the stoichiometry of the oxidant of the combustion materials towards the exhaust; and or provide the combustion materials to the outer surface of the porous sleeve with decreased stoichiometry of an the oxidant of the combustion materials towards the exhaust compared to the stoichiometry of the oxidant of the combustion materials towards the effluent gas stream inlet.

5. The radiant burner of claim 2, wherein the combustion materials comprise a fuel and oxidant mixture and the plenum is configured to lower a fuel to oxidant ratio towards the effluent gas stream inlet.

6. The radiant burner of claim 2, wherein the combustion materials comprise a fuel and oxidant mixture and the plenum is configured to raise a fuel to oxidant ratio towards the exhaust.

7. The radiant burner of claim 2, wherein the combustion materials comprise a fuel and oxidant mixture and the plenum is configured to lower a fuel to oxidant ratio towards the effluent gas stream inlet compared to a fuel to oxidant ratio towards the exhaust.

8. The radiant burner of claim 2, wherein the combustion materials comprise a fuel and oxidant mixture and the plenum is configured to raise a fuel to oxidant ratio towards the exhaust compared to a fuel to oxidant ratio towards the effluent gas stream inlet.

9. The radiant burner of claim 2, wherein the plenum comprises a combustion materials inlet which provides the combustion materials to the plenum and an oxidant inlet which provides oxidant in a vicinity of the effluent gas stream inlet to increase the stoichiometry of the oxidant of the combustion materials towards the effluent gas stream inlet.

10. The radiant burner of claim 9, wherein the plenum comprises an oxidant inlet baffle in a vicinity of the oxidant inlet to create a region of increased stoichiometry of the oxidant of the combustion materials towards the effluent gas stream inlet.

11. The radiant burner of claim 2, wherein the plenum comprises a combustion materials inlet which provides the combustion materials to the plenum and a fuel inlet which provides fuel in a vicinity of the exhaust to decrease the stoichiometry of an oxidant of the combustion materials towards the exhaust.

12. The radiant burner of claim 11, wherein the plenum comprises a fuel inlet baffle in a vicinity of the fuel inlet to create a region of decreased stoichiometry of an oxidant of the combustion materials towards the exhaust.

13. The radiant burner of claim 12, wherein the fuel inlet baffle reduces fluid communication between a region in a vicinity of the combustion materials inlet and regions in a vicinity of the fuel inlet and the oxidant inlet to vary the stoichiometry of an oxidant in these regions.

14. The radiant burner of claim 1, wherein the plenum comprises a plurality of adjacent plenums, each providing combustion materials with differing stoichiometry to the outer surface of the porous sleeve opposite the combustion surface.

15. A method of treating an effluent gas stream from a manufacturing process tool, the method comprising:

combusting combustion materials proximate to a combustion surface of a porous sleeve of a combustion; and supplying the combustion materials, to an outer surface of the porous sleeve opposite the combustion surface, from a plenum surrounding the porous sleeve with varying stoichiometry along a length of the porous sleeve.

16. The method of claim 15, wherein the combustion chamber extends axially from an effluent gas stream inlet from which the effluent gas is provided to the combustion chamber to an exhaust from which treated effluent gas is exhausted, and supplying the combustion materials to the porous sleeve comprises supplying the combustion materials with varying stoichiometry along an axial length of the porous sleeve.

17. The method of claim 16, wherein supplying the combustion materials with varying stoichiometry along an axial length of the porous sleeve comprises at least one of:

increasing the stoichiometry of an oxidant of the combustion materials towards the effluent gas stream inlet; or decreasing the stoichiometry of the oxidant of the combustion materials towards the exhaust.

18. The method of claim 16, wherein supplying the combustion materials with varying stoichiometry along an axial length of the porous sleeve comprises at least one of:

providing combustion materials with an increased stoichiometry of an oxidant of the combustion materials towards the effluent gas stream inlet compared to stoichiometry of the oxidant of the combustion materials towards the exhaust; or providing combustion materials with a decreased stoichiometry of the oxidant of the combustion materials towards the exhaust compared to stoichiometry of the oxidant of the combustion materials towards the effluent gas stream inlet.

* * * * *